US010042320B2

(12) United States Patent
Mochizuki et al.

(10) Patent No.: US 10,042,320 B2
(45) Date of Patent: Aug. 7, 2018

(54) PROCESS CARTRIDGE AND ELECTROPHOTOGRAPHIC IMAGE FORMING APPARATUS FOR FORMING A HIGH-QUALITY ELECTROPHOTOGRAPHIC IMAGE

(71) Applicant: CANON KABUSHIKI KAISHA, Tokyo (JP)

(72) Inventors: Kenichi Mochizuki, Mishima (JP); Takuma Matsuda, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/621,951

(22) Filed: Jun. 13, 2017

(65) Prior Publication Data

US 2017/0357209 A1 Dec. 14, 2017

(30) Foreign Application Priority Data

Jun. 14, 2016 (JP) ..... 2016-118398
Aug. 8, 2016 (JP) ..... 2016-155783

(51) Int. Cl.
*G03G 21/18* (2006.01)
*G03G 15/08* (2006.01)

(52) U.S. Cl.
CPC ..... *G03G 21/1814* (2013.01); *G03G 15/0812* (2013.01)

(58) Field of Classification Search
CPC ..... G03G 21/1839; G03G 15/0121; G03G 15/757; G03G 21/1661; G03G 2221/183
USPC ..... 399/274, 111
See application file for complete search history.

(56) References Cited

U.S. PATENT DOCUMENTS 5,552,867 A * 9/1996 Sekino ..... G03G 15/0812 399/284
5,895,151 A * 4/1999 Kinoshita ..... G03G 15/0812 399/284
7,236,729 B2 * 6/2007 Askren ..... G03G 15/0812 399/264

FOREIGN PATENT DOCUMENTS

JP 9-329961 A 12/1997
JP 2000-284589 A 10/2000
JP 2000-347500 A 12/2000
JP 2008-275662 A 11/2008
JP 2013-218289 A 10/2013
(Continued)

*Primary Examiner* — Billy Lactaoen
(74) *Attorney, Agent, or Firm* — Canon U.S.A., Inc. IP Division

(57) ABSTRACT

A process cartridge includes an electrophotographic photosensitive drum, a developer bearing roller, and a developer regulating member, the developer regulating member and the developer bearing roller constituting a contact region, the contact region having a width larger than the width of the developing region in the direction of the axis of the developer bearing roller and extending in the circumferential direction of the developer bearing roller, the developer regulating member having a protruding portion that protrudes over the entire width of the contact region from the end portion on the upstream side of the contact region toward the upstream side in the rotational direction of the roller, and the length of the protruding portion in a region corresponding to the developing region being substantially constant and larger than the length of the protruding portion at the location corresponding to the end portion in the width direction of the contact region.

8 Claims, 4 Drawing Sheets

(56) References Cited

FOREIGN PATENT DOCUMENTS

| | | | |
|---|---|---|---|
| JP | 2015-49371 | A | 3/2015 |
| JP | 2016-12105 | A | 1/2016 |

* cited by examiner

PROCESS CARTRIDGE AND ELECTROPHOTOGRAPHIC IMAGE FORMING APPARATUS FOR FORMING A HIGH-QUALITY ELECTROPHOTOGRAPHIC IMAGE

BACKGROUND OF THE INVENTION

Field of the Invention

The present disclosure relates to a process cartridge and an electrophotographic image forming apparatus which are used for image forming by electrophotography.

Description of the Related Art

Japanese Patent Laid-Open No. 9-329961 describes an invention related to a developing apparatus. Japanese Patent Laid-Open No. 9-329961 provides a developing apparatus capable of reliably preventing the occurrence of fogging of an image bearing member due to toner and the occurrence of scattering and falling of drops of toner at both end portions in the longitudinal direction of the developer bearing member during development, and stably and favorably forming a toner thin layer on a developer bearing member by using an elastic regulating blade. The developing apparatus disclosed in Japanese Patent Laid-Open No. 9-329961 has the configuration described below.

A developing apparatus includes:

a rotatable developer bearing member, an elastic regulating blade that constitutes a nip portion with the developer bearing member so as to regulate the layer thickness of a developer borne on the developer bearing member in the nip portion, and end portion seal members disposed at both end portions in the longitudinal direction of the developer bearing member, wherein the distance from a downstream point in the rotational direction of the developer bearing member of the nip portion to the front edge portion of the elastic regulating lade is a predetermined distance within the range corresponding to a developing region in the longitudinal direction of the elastic regulating blade and the distance continuously decreases toward the side end portion of the elastic regulating blade outside the range corresponding to the developing region, and the front edge portion of the side end portion of the elastic regulating blade is located in the nip portion.

The present inventors performed research regarding a further improvement in the performance of the developing apparatus according to Japanese Patent Laid-Open No. 9-29961. As a result, a new problem was found. Specifically, in some cases, soiling adhered to a portion of an electrophotographic image corresponding to the end portion in the longitudinal direction of an electrophotographic photosensitive drum (hereafter also referred to as an edge region of an electrophotographic image), the image formed by using the developing apparatus according to Japanese Patent Laid-Open No. 9-329961. This phenomenon was conspicuous particularly in the case where the electrophotographic image was formed in a high-temperature and high-humidity atmosphere, for example, at a temperature of 30° C. and a relative humidity of 80%.

SUMMARY OF THE INVENTION

Accordingly, an aspect of the present disclosure is to provide a process cartridge and an electrophotographic image forming apparatus which are useful for stably forming a high-quality electrophotographic image.

An aspect according to the present disclosure provides a process cartridge including: an electrophotographic photosensitive drum, a developer bearing roller for supplying a developer to an electrostatic latent image forming region of the electrophotographic photosensitive drum, and a developer regulating member in contact with a surface of the developer bearing roller, wherein the developer bearing roller is rotatable in the direction of supplying the developer to the electrostatic latent image forming region and has a developer bearing region on the surface, the developer bearing region includes a developing region for bearing the developer with which an electrostatic latent image formed in the electrostatic latent image forming region is developed, the developer bearing region has a width, in the direction of the axis of the developer bearing roller, larger than the width of the developing region, the developer regulating member and the developer bearing roller are arranged such that the center of the developer regulating member is in accord with the center of the developer bearing region in the direction of the axis of the developer bearing roller so as to constitute a contact region, the contact region has a width larger than the width of the developing region in the direction of the axis of the developer bearing roller and extends in the circumferential direction of the developer bearing roller, the developer regulating member has a protruding portion that protrudes over the entire width of the contact region from the end portion on the upstream side of the contact region in the upstream direction and in the direction in which the developer bearing roller is rotatable, and the protrusion length of the protruding portion in a region corresponding to the developing region is substantially constant and larger than the protrusion length of the protruding portion at the location corresponding to the end portion in the width direction of the contact region. Another aspect according to the present disclosure provides an electrophotographic image forming apparatus including an electrophotographic photosensitive drum, a developer bearing roller for supplying a developer to an electrostatic latent image forming region of the electrophotographic photosensitive drum, and a developer regulating member in contact with a surface of the developer bearing roller, wherein the developer bearing roller is rotatable in the direction of supplying the developer to the electrostatic latent image forming region and has a developer bearing region on the surface, the developer bearing region includes a developing region for bearing the developer with which an electrostatic latent image formed in the electrostatic latent image forming region is developed, the developer bearing region has a width, in the direction of the axis of the developer bearing roller, larger than the width of the developing region, the developer regulating member and the developer bearing roller are arranged such that the center of the developer regulating member is in accord with the center of the developer bearing region in the direction of the axis of the developer bearing roller so as to constitute a contact region, the contact region has a width larger than the width of the developing region in the direction of the axis of the developer bearing roller and extends in the circumferential direction of the developer bearing roller, the developer regulating member has a protruding portion that protrudes over the entire width of the contact region from the end portion on the upstream side of the contact region in the upstream direction and in the direction in which the developer bearing roller is rotatable, and the protrusion length of the protruding portion in a region corresponding to the developing region is substantially constant and larger than the protrusion length of the protruding portion at the location corresponding to the end portion in the width direction of the contact region.

Further features of the present disclosure will become apparent from the following description of exemplary embodiments with reference to the attached drawings.

DESCRIPTION OF THE EMBODIMENTS

Figure 1A:
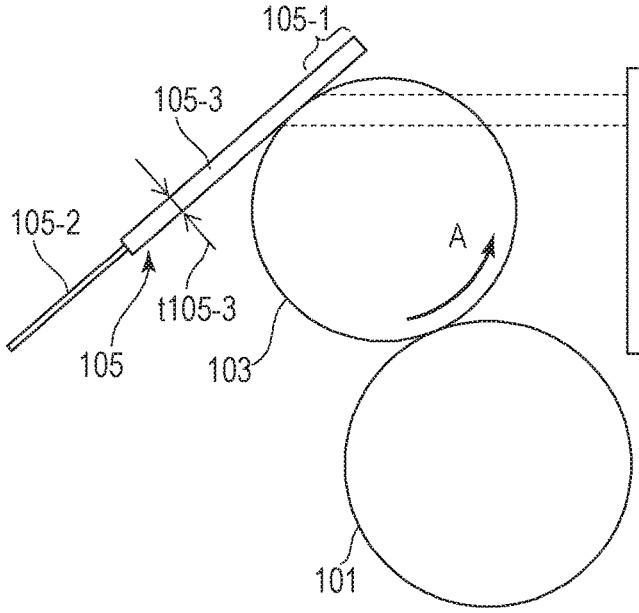
FIGS. 1A and 1B are explanatory diagrams of a process cartridge according to an aspect of the present disclosure.

The present inventors conjectured that, in the case where an electrophotographic image is formed by using the developing apparatus according to Japanese Patent Laid-Open No. 9-329961, soiling adheres to an edge region of an electrophotographic image for the reason described below.

According to the description in paragraph [0060] of Japanese Patent Laid-Open No. 9-329961, the following are known regarding the positional relationship between a contact nip portion and an elastic blade.

The thickness of a toner layer formed on a developing sleeve is influenced by the distance from an upstream point in the rotational direction of the developing sleeve of the nip portion to the front edge of the elastic blade.

As the above-described distance increases, the thickness of the toner layer formed on the developing sleeve increases, and as the distance decreases, the thickness of the toner layer formed on the developing sleeve decreases.

According to the description in the example of Japanese Patent Laid-Open No. 9-329961, the contact positions at both end portions of the elastic blade are configured to be located in the contact nip and to have edge contact with the developing sleeve. Further, the following points are described in paragraphs [0061] to [0064]. The width of the contact nip is about 1.0 mm, the distance d from a downstream edge in the rotational direction of the developing sleeve of the contact nip to the front edge of the elastic blade is 1.5 mm in a regular developing region and continuously decreases toward the outside of the developing region, and the distance e at the end edge position is 1.5 mm.

That is, in the developing apparatus according to Japanese Patent Laid-Open No. 9-329961, the front edge portion of the elastic blade protrudes by 0.5 mm from the upper end of the contact nip in the developing region of the developing sleeve and, thereby, a toner layer having a stable thickness is formed.

On the outside of the developing region in the width direction of the apparatus according to Japanese Patent Laid-Open No. 9-329961, the length of the front edge portion of the elastic blade gradually decreases, and both end portions of the elastic blade are located in the nip portion. Consequently, the thickness of the toner layer outside the developing region may be inconsistent in a non-developing region, the sliding distance between the developing sleeve and the elastic blade is small. Further, in a high-temperature and high-humidity atmosphere, the triboelectricity of the toner tends to be degraded. As a result, sufficient frictional charge is not provided to the toner in the non-developing region, and a binding force of the developing sleeve may be insufficient. It is considered that the toner in this region is thereby easily scattered and adheres to the end portion of the image, thereby causing soiling.

Accordingly, the present inventors performed research for the purpose of stabilizing the layer thickness of a developer adhering to a region that is a developer bearing region of a developer bearing roller and a region outside the developing region (hereafter also referred to as "non-developing region") and for the purpose of stabilizing triboelectricity of the developer.

The present inventors found a combination of the following configurations for achieving the above-described purpose.

A protruding portion that protrudes upstream in the rotational direction of the developer bearing roller is provided over the entire width of a contact region formed by a developer regulating member and the developer bearing roller.

The protrusion length of the protruding portion at the location corresponding to the end portion in the width direction of the contact region is made smaller than the protrusion length of the protruding portion in the region corresponding to the developing region of the developer bearing roller.

The contact region formed by the developer regulating member and the developer bearing roller has a predetermined width in the direction of the axis of the developer bearing roller and has a predetermined length in the circumferential direction of the developer bearing roller.

The present inventors further found that the following effects were obtained by using the above-described combination of configurations.

A developer layer having a thickness smaller than the thickness of a developer layer formed in the developing region is stably formed in the non-developing region of the developer bearing roller.

The frictional charge of the developer constituting the developing layer is stabilized even under a high-temperature and high-humidity atmosphere.

Soiling due to adhesion of the toner to the end portion of an electrophotographic image formed at a high temperature and a high humidity is suppressed significantly.

An electrophotographic apparatus according to an aspect of the present disclosure has a form of a process cartridge or an electrophotographic image forming apparatus and includes an electrophotographic photosensitive drum, a developer bearing roller, and a developer regulating member.

The electrophotographic photosensitive drum has an electrostatic latent image forming region, and a developer is supplied to the electrostatic latent image forming region by the developer bearing roller.

The developer bearing roller is rotatable in a predetermined direction of supplying the developer to the electrostatic latent image forming region of the electrophotographic photosensitive drum and has a developer bearing region on the surface.

The width of the developer bearing region is larger than the width of the electrostatic latent image forming region, and a developing region corresponding to the electrostatic latent image forming region is formed in the developer bearing region.

The developer regulating member and the developer bearing roller are arranged such that the center in the direction of the axis of the developer bearing roller of the developer regulating member is in accord with the center in the width direction of the developer bearing region. In this regard, in the case where the length in the direction of the axis of the developer bearing roller of the developer regulating member is larger than the length in the direction intersecting the axis direction, the direction of the axis of the developer bearing roller of the developer regulating member corresponds to a longitudinal direction of the developer regulating member.

The developer regulating member and the developer bearing roller have predetermined widths and form a contact region having a predetermined length in the circumferential direction of the developer bearing roller. The developer bearing region and the developing region are included in the contact region, and the width of the developer bearing region is set to be larger than the width of the developing region.

The developer regulating member has a protruding portion that protrudes upstream in the rotational direction of the developer bearing roller over the entire width of the contact region. The protrusion length of the protruding portion in a region corresponding to the developing region of the developer bearing roller is substantially constant and is set to be larger than the protrusion length of the protruding portion at the location corresponding to the end portion in the width direction of the contact region.

That is, the protruding portion of the developer regulating member is a portion protruding from the contact region that is a base portion and the protruding portion has a region that is a portion corresponding to the developing region and end portions corresponding to portions that extend to both sides of the developing region in the width direction. The developer regulating member and the developer bearing roller are arranged such that the center in the direction in the width direction of the protruding portion is in accord with the center in the width direction of the developing region.

In this regard, in the present disclosure, the "width" of each of the regions and the portions refers to the width in the direction of the axis (axis of rotation) of the developer bearing roller.

A process cartridge according to an aspect of the present disclosure will be described below with reference to the drawings, but the technical scope of the present disclosure is not limited to these drawings.

FIG. 1A shows an electrophotographic photosensitive drum 101, a developer bearing roller 103, and a developer regulating member 105 among the constituent members of a process cartridge according to an aspect of the present disclosure. The developer bearing roller 103 is rotatable in the direction of arrow A.

Figure 1B:
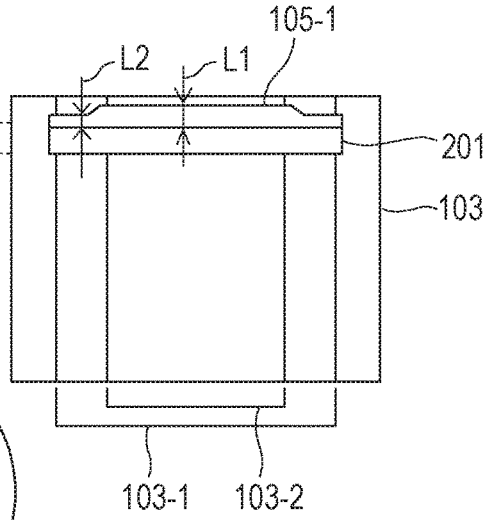

FIG. 1B is an explanatory diagram schematically showing a contact region 201 between the surface of the developer bearing roller and the developer regulating member and the relationship between the contact region and the shape of a protruding portion 105-1 of the developer regulating member. Regarding the developer regulating member, portions other than the contact region 201 and the protruding portion 105-1 are not shown in FIG. 1B for the sake of facilitating understanding.

The developer bearing roller 103 has a developer bearing region 103-1 on the surface. A toner layer formed in the developer bearing region is transferred to an area in contact with or near the surface of the electrophotographic photosensitive drum 101 in accordance with rotation of the developer bearing roller 103 in the direction of arrow A. Subsequently, an electrostatic latent image formed on the surface of the electrophotographic photosensitive drum is developed by the toner present in a region (also referred to as a "developing region") 103-2, which corresponds to an electrostatic latent image forming region (not shown in the drawing) on the surface of the electrophotographic photosensitive drum 101, in the developer bearing region 103-1. That is, the width of the developer bearing region is larger than the width of the electrostatic latent image forming region of the electrophotographic photosensitive drum.

The developer regulating member 105 is arranged such that the center of the width thereof is in accord with the center of the width of the protruding portion 105-1. The "concordance" of these centers includes the case where these centers "are substantially in accord" with each other, that is, includes the case where these centers are perfectly in accord with each other and the case where deviation of the two centers from each other is more than 0 mm and 5 mm or less.

The contact region 201 formed by the developer regulating member 105 coming into contact with the surface of the developer bearing roller 103 has a predetermined width and a predetermined length in the circumferential direction of the developer bearing roller. Also, the width of the contact region 201 is larger than the width of the developing region 103-2.

The developer regulating member 105 has a protruding portion 105-1 that protrudes upstream in the rotational direction indicated by arrow A of the developer bearing roller 103 (also simply referred to as "upstream in the rotational direction") over the entire width of the contact region 201. A region corresponding to the developing region 103-2 includes a portion continuously having a length (hereafter also referred to as "protrusion length") L1 from the end portion on the upstream side in the rotational direction of the contact region 201 to the front edge on the developer bearing roller surface side of the protruding portion.

The protrusion length L1 in the width direction of the protruding portion 105-1 may have variations within the range in which effects according to the present embodiment are exerted. That is, L1 may be substantially constant in the width direction. "Substantially constant" refers to the case where formula (1) below is satisfied when a maximum value of the protrusion length of the protruding portion in the region corresponding to the developing region 103-2 is assumed to be L1max and a minimum value is assumed to be $L1^{min}$.

$$[(L1\max - L1\min)/L1\max] \geq 0.4 \qquad \text{Formula (1):}$$

It is preferable that L1max be 0.5 mm or more and 5.0 mm or less.

Each of the end portions in the width direction of the protruding portion 105-1 of the developer regulating member 105 includes an end edge having a length of L2, and the protrusion length of the end portion is set to be L2 or more and smaller than L1.

As described above, in the process cartridge according to the present embodiment, the developer regulating member 105 has the protruding portion 105-1 extending over the entire width of the contact region 201. The protrusion length of the end portion of the protruding portion 105-1 at the location corresponding to the end portion in the width direction of the contact region 201 is smaller than the protrusion length L1 of the region corresponding to the developing region 103-2. In these points, the developer regulating member 105 is different from the elastic blade in the image forming apparatus according to Japanese Patent Laid-Open No. 9-329961.

The process cartridge according to the present embodiment has the above-described configuration and, thereby, a layer of the developer having a constant thickness is stably formed in a region in the contact region 201 and outside the developing region 103-2. The layer thickness of the developer in this region is smaller than the layer thickness of the developer formed in the developing region 103-2. The developer in the developer layer formed in the region in the contact region 201 and outside the developing region 103-2 passes along the length of the contact region 201 in the same manner as the developer in the developer layer formed in the developing region. Consequently, a sufficient frictional charge is provided to the developer in the developer layer formed in the region in the contact region 201 and outside the developing region 103-2.

As a result, the developer located outside the developing region 103-2 in the width direction is further reliably bound by the developer bearing roller 103, and unfavorable adhesion to the end portion in the width direction of an electrophotographic image is suppressed.

Each member constituting the process cartridge according to the present embodiment will be described below in detail.

Developer Regulating Member

As shown in FIG. 1A, the developer regulating member 105 includes a blade portion 105-3 that comes into contact with the developer bearing roller 103 so as form the contact region 201 and a supporting portion 105-2 for supporting the blade portion.

The supporting portion 105-2 and the blade portion 105-3 may be formed of the same material or of materials different from each other.

Specific examples of materials for forming the blade portion 105-3 include resins, e.g., urethane, silicone, polyethylene terephthalate, acryl, polyethylene, and polystyrene, and metals, e.g., stainless steel, phosphor bronze, and aluminum.

Specific examples of materials for forming the supporting portion 105-2 include resins, e.g., urethane, silicone, polyethylene terephthalate, acryl, polyethylene, and polystyrene, and metals, e.g., stainless steel, phosphor bronze, and aluminum, as is the case with the material for forming the blade portion 105-3.

There is no particular limitation regarding the thickness t105-3 of the blade portion 105-3. The thickness t105-3 is preferably selected within the range of 0.05 mm or more and 3 mm or less and is more preferably selected within the range of 0.8 mm or more and 3 mm or less. In the case where the thickness is within such a range, the blade portion 105-3 forms the developer layer having a predetermined thickness on the surface of the developer bearing roller and has an elasticity such that a pressure sufficient for providing frictional charge to the developer may be sufficiently applied.

The developer regulating member including a thermosetting resin blade portion 105-3 may be produced by, for example, a centrifuge molding method. In the centrifuge molding method, a resin raw material is put into a cylindrical mold, a resin raw material layer is formed on the inner peripheral surface by a centrifugal force due to high speed rotation, and the resulting layer is heat-cured so as to form a thin sheet having a cylindrical shape. The thus produced cylindrical sheet, which is a molded article, is removed from the cylindrical mold, secondary cross-linking is performed as necessary, and cutting into predetermined dimension and shape is performed as necessary. Examples of cutting methods include known cutting methods by using a Vic blade, a laser, a cutter, and the like.

The developer regulating member including a thermoplastic resin blade portion 105-3 may be produced by, for example, extrusion molding or injection molding. Specifically, in the case where extrusion molding is used, molding is performed by injecting a heat-melted thermoplastic resin into an injection mold. In the case where injection molding is used, molding may be performed by injecting a thermoplastic resin into a mold cavity and performing cooling. Regarding the shape of the blade portion 105-3, a method in which the mold cavity is processed into a predetermined shape may be used and, as necessary, cutting may be further performed after molding. In the case where the developer regulating member 105 includes a metal blade portion 105-3, the blade portion may be produced by processing the blade portion into a predetermined shape by a method involving pressing, electrochemical machining, electrical discharge machining, laser beam machining, or the like.

Shape of Developer Regulating Member

The protruding portion 105-1 of the developer regulating member according to the present embodiment can have the shape described with reference to FIGS. 2A and 2B.

Figure 2A:
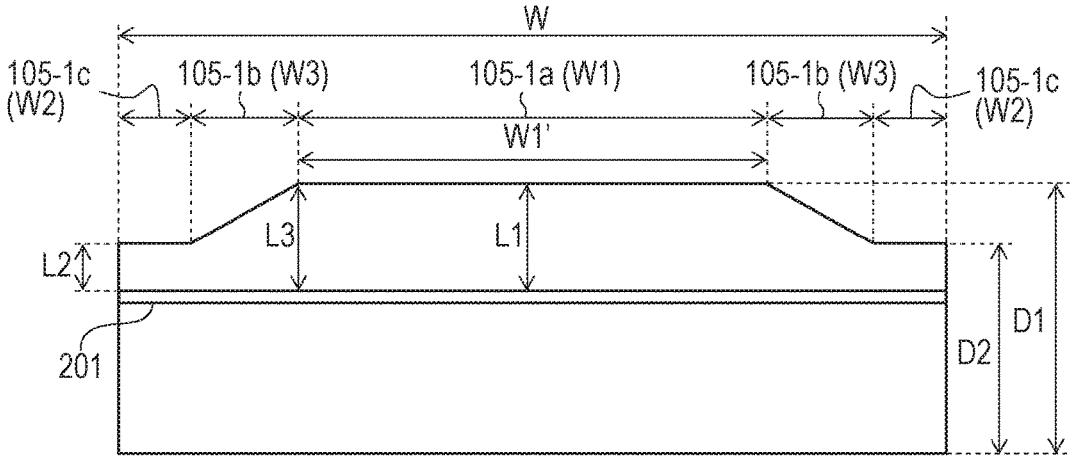
FIGS. 2A and 2B are explanatory diagrams of developer regulating members according to an aspect of the present disclosure.
Figure 2B:
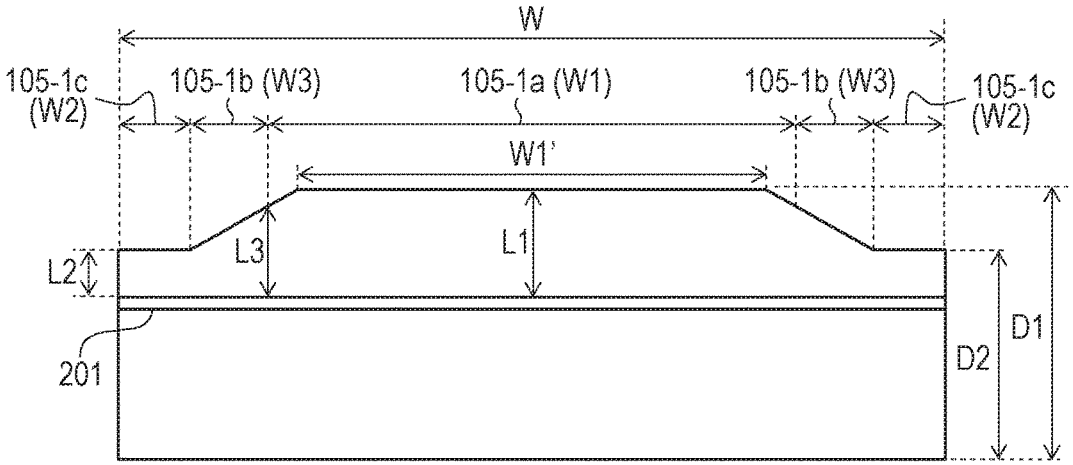
Figure 3:
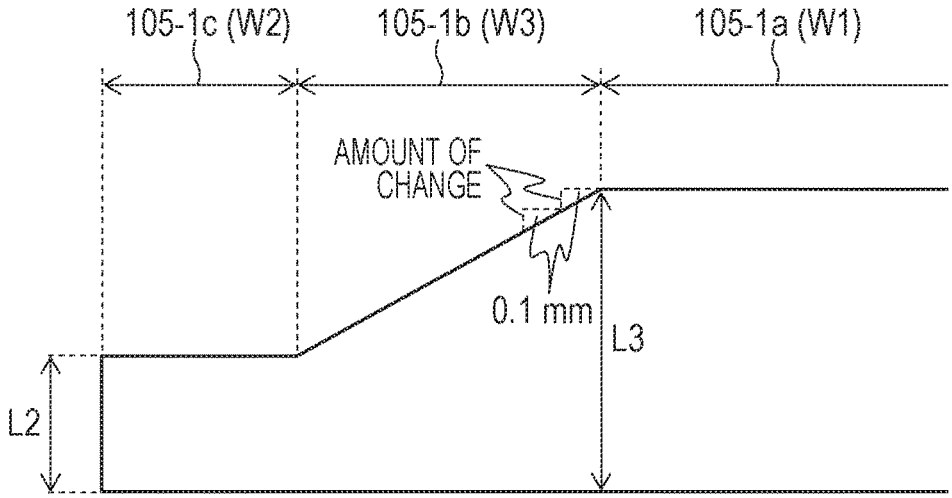
FIG. 3 is a diagram showing a method for measuring an amount of change in the length L of a protruding portion.

Each of FIGS. 2A and 2B is a plan view of the protruding portion 105-1 surface, which faces the surface of the developer bearing roller, and shows the relationship between each of the lengths of the regions.

The protruding portion 105-1 has a region 105-1*a* corresponding to the developing region 103-2 of the developer bearing roller. The region 105-1*a* has a substantially constant protrusion length L1. The region 105-1*a* shown in FIG. 2A is composed of a portion having a protrusion length L1 throughout the width thereof. The region 105-1*a* shown in FIG. 2B is composed of a portion having a substantially constant protrusion length L1. In each of FIGS. 2A and 2B, the protrusion length of the end portion in the width direction of the region 105-1*a* is specified as L3. In FIG. 2A, L1=L3 holds and in FIG. 2B, L1>L3 holds.

The end edge of the protruding portion has a protrusion length L2. The relationship between the protrusion length L2 and the protrusion length L3 can be selected within the range of $L2 \leq L3 \times 0.8$.

The ratio of the width W1' of the region having a protrusion length L1 to the width W1 of the region 105-1*a* may be selected so as to satisfy $W1'/W1 \geq 0.85$.

The center in the width direction of the region 105-1*a* shown in each of FIG. 2A and FIG. 2B is arranged so as to be in accord with the center in the width direction of the protruding portion 105-1.

The end portion of the protruding portion may be composed of only the end edge portion having a protrusion length L2 or be composed of a connection region and an edge region as described later. The width of the end portion of the protruding portion ((W2+W3) in the form shown in FIGS. 2A and 2B) can be 2 mm or more and 10 mm or less.

Further, each of both end portions of the protruding portion 105-1 corresponding to both end portions in the width direction of the contact region may be the end portion composed of a connection region 105-1*b*, in which the protrusion length gradually decreases toward the end edge direction, and an edge region 105-1*c* including the end edge.

The edge region 105-1*c* is a portion having an end edge protrusion length L2 in the width direction continuously. The protrusion length L2 is substantially constant in the width direction thereof. Here, "substantially constant" refers to that the protrusion length in this region is within the range of 0.8×L2 (mm) or more and 1.2×L2 (mm) or less with reference to the protrusion length L2 (mm) at the location corresponding to the end portion of the contact region.

As described above, the connection region 105-1*b* may be present between the region 105-1*a* and the edge region 105-1*c*. The protrusion length in the connection region gradually decreases from the start point that is the location corresponding to the end portion in the width direction of the developing region 103-2 (that is, the end portion in the width direction of the region 105-1*a*) toward the location corresponding to the end portion in the width direction of the contact region. In the case where such a shape is taken, a thin developer layer is formed in a non-developing region in the width direction of the developer bearing region of the developer bearing roller. Also, sharp changes in the thickness of the developer layer in the non-developing region adjacent to the developing region are suppressed.

The width W3 of the connection region 105-1*b* is preferably 1 mm or more and more preferably 2 mm or more. The upper limit of the width W3 of the connection region 105-1*b* is preferably 10 mm or less.

The amount of change in the protrusion length in the connection region can be 0.1×L3 (mm) or less per 0.1 mm of the width, when the protrusion length of the end portion in the region 105-1*a* corresponding to the end portion in the width direction of the developing region is assumed to be L3 (mm). By disposing the connection region, in which the protrusion length of the protruding portion changes as such, the degree of change in the layer thickness of the developer in an adjacent region in the non-developing region to the developing region with respect to the layer thickness of the developer in the edge region in the width direction of the developing region, is moderate. As a result, the layer thickness of the developer in the edge region in the developing region is further stabilized, and the image quality of the electrophotographic image is further improved.

The width W2 of the edge region 105-1*c* can be set to be 1.0 mm or more and 5.0 mm or less. Toner adhesion to the edge region of the image is further suppressed by setting the width of the region, in which the layer thickness of the developer is substantially constant, to be within the above-described range in the non-developing region in the contact region.

Measurement of Length of Protruding Portion

The developer regulating member is incorporated into an image forming apparatus and images are formed. The developer regulating member is removed after image forming, and the contact region is determined on the basis of traces of sliding on the developer bearing roller. The distance from a start point that is the end portion on the upstream side in the rotational direction of the developer bearing roller to the front edge of the surface that faces the surface of the developer bearing roller of the developer regulating member in the contact region is measured by using a digital microscope (for example, trade name: VHX-5000 produced by KEYENCE CORPORATION) and is taken as the protrusion length.

Developer Bearing Roller

Figure 4:
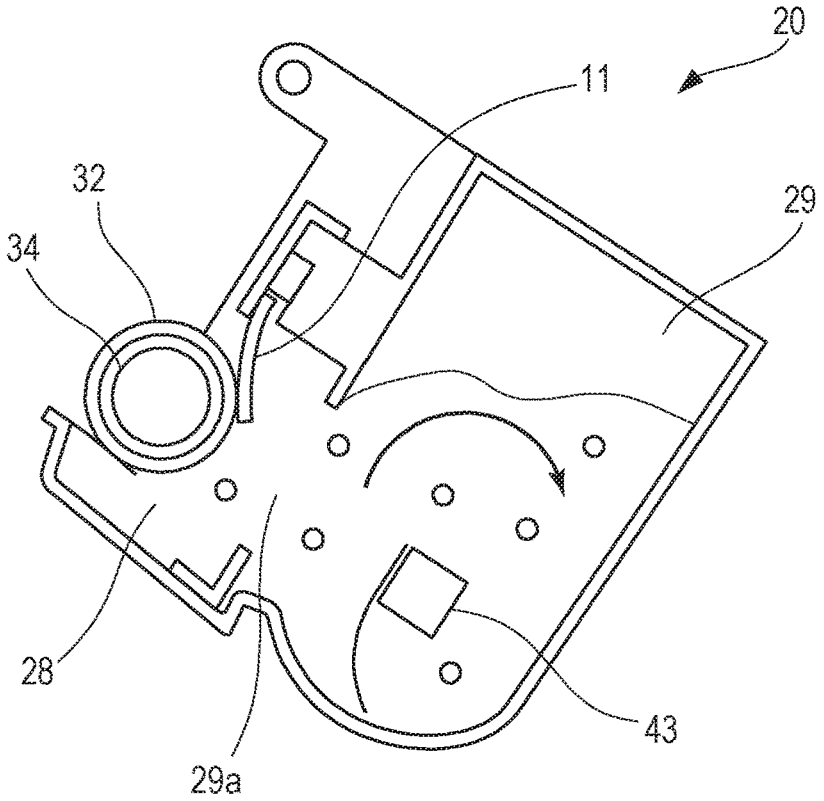
FIG. 4 is a schematic sectional view showing an example of a developing apparatus according to the present disclosure.
Figure 5:
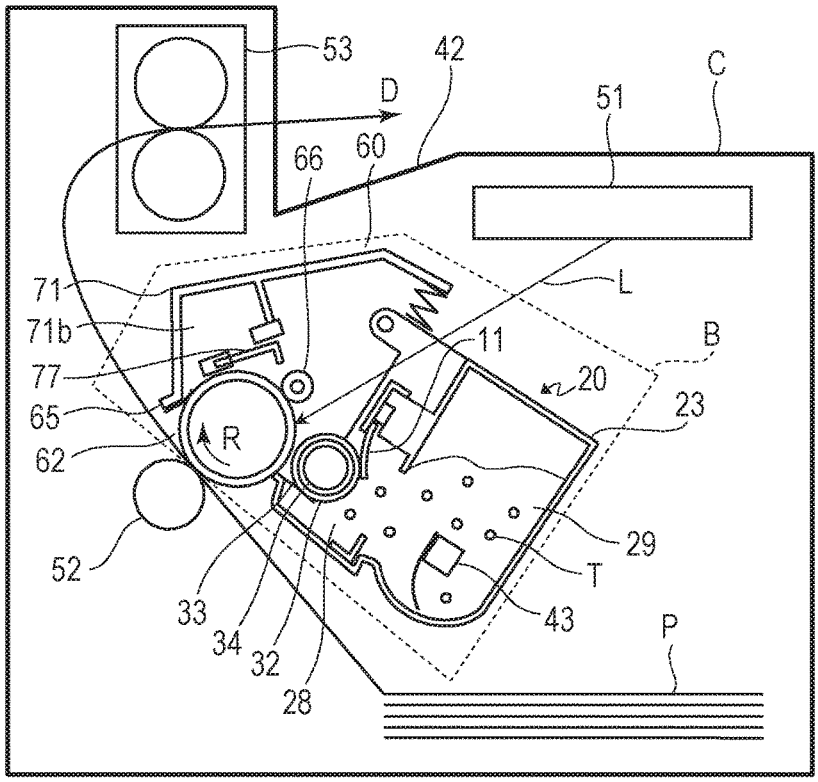
FIG. 5 is a schematic configuration diagram showing an example of a process cartridge and an electrophotographic image forming apparatus according to the present disclosure.

Regarding a developer bearing roller 32 used in a developing apparatus shown in FIG. 4 and a process cartridge B and an image forming apparatus C shown in FIG. 5, known developer bearing rollers, e.g., a developing sleeve including a magnet roller 34 and an elastic roller, in which an outer peripheral surface of a core body is coated with an elastic layer and, as necessary, an outer peripheral surface of the elastic layer is coated with a surface layer, may be used.

A developer bearing roller composed of conductive base member and a surface layer disposed on the outer periphery of the base member, may be used.

Examples of the conductive base member include cylindrical members and cylindrical columnar members.

Examples of materials for forming the base member include nonmagnetic metals and alloys, e.g., aluminum, stainless steel, and brass. A material, in which a rubber layer or a resin layer is disposed on the base member, may be used as the base member.

A surface layer produced by mixing a conducting agent into a resin may be used. In order to adjust the surface profile of the developer bearing roller, unevenness-providing particles may be added to the surface layer. Further, in order to adjust the charge-providing performance of the developer bearing roller, a charge control agent may be added to the surface layer.

Examples of resins include the following: thermoplastic resins, e.g., styrene-based resins, vinyl resins, polyether sulfone resins, polycarbonate resins, polyphenylene oxide resins, polyamide resins, fluororesins, thermoplastic cellulose resins, and acrylic resins, and thermosetting resins or photo-curable resins, e.g., epoxy resins, polyester resins, alkyd resins, phenol resins, melamine resins, polyurethane resins, urea resins, silicone resins, and polyimide resins.

These may be used alone or in combination.

Examples of the material for forming the conducting agent include the following:

fine powders of metal fine particles of aluminum, copper, nickel, silver, and the like, metal oxides, e.g., antimony oxide, indium oxide, tin oxide, titanium oxide, zinc oxide, molybdenum oxide, and potassium titanate, carbon fibers, carbon black, e.g., furnace black, lamp black, thermal black, acetylene black, and channel black, and carbides, e.g., graphite.

The volume average particle diameter of the unevenness-providing particles is preferably 1 to 20 μm, and more preferably 2 to 10 μm in order to form appropriate unevenness on the surface of the resin layer. In the case where the volume average particle diameter is 1 μm or more, the resin layer can be provided with appropriate surface roughness even when the content is small. In the case where the volume average particle diameter of the unevenness-providing particles is 20 μm or less, nonuniformity in surface roughness of the resin layer and insufficient triboelectric charging of the developer due to excessive increase in roughness are suppressed, and degradation of image quality, e.g., fogging and density reduction, of the resulting image is suppressed.

Regarding such unevenness-providing particles, resin particles, metal oxide particles, carbonized particles, and the like may be used. The shape of the unevenness-providing particles can be spherical or the like because uniform dispersion into the resin layer occurs easily.

A value measured by using a laser diffraction particle size analyzer may be adopted as the volume average particle diameter of the unevenness-providing particles.

Examples of charge control agents include the following:

nigrosine and nigrosine modified with fatty acid metal salts and the like, quaternary ammonium salts, e.g., tributylbenzylammonium-1-hydroxy-4-naphthosulfonate and tetrabutylammonium tetrafluoroborate, onium salts, e.g., phosphonium salts, that are analogs of these, and lake pigments of these (laking agents include phosphotungstic acid, phosphomolybdic acid, phosphotungstomolybdic acid, tannic acid, lauric acid, gallic acid, ferricyanides, ferrocyanides, and the like), higher fatty acid metal salts; butyltin oxide, diorganotin oxides, e.g., dioctyltin oxide and dicyclohexyltin oxide; diorganotin borates, e.g., dibutyltin borate, dioctyltin borate, and dicyclohexyltin borate; guanidine and the like, and imidazole compounds. These may be used alone or in combination.

The surface layer may be formed by dispersing and mixing components for the surface layer into a solvent so as to produce a coating solution, coating a base member with the coating solution, and performing drying-solidification or curing. Known dispersing apparatuses, e.g., a sand mill, a paint shaker, DYNO-MILL, and a pearl mill, including beads can be used for dispersing and mixing components into the coating solution. Regarding the coating method, known methods, e.g., a dipping method, a spraying method, and a roll coating method, may be applied.

Developer

The developer (toner) contains a binder resin, a colorant, a charge control agent, a release agent, inorganic fine particles, and the like. The developer may be a magnetic toner containing a magnetic material as an indispensable component or a nonmagnetic toner not containing a magnetic material.

The mass average particle diameter of the developer can be within the range of 4 μm or more and 10 μm or less because a balance between the triboelectric charge quantity of the developer or the image quality and the image density is achieved. In the case where the mass average particle diameter of the developer is 10 μm or less, degradation of the reproducibility of a microdot image is further effectively suppressed. Meanwhile, in the case where the mass average particle diameter of the developer is or more, occurrence of density reduction due to insufficient triboelectric charge is further effectively suppressed.

Regarding the binder resin for the developer, vinyl resins, polyester resins, polyurethane resins, epoxy resins, and phenol resins may be used. In particular, vinyl resins and polyester resins can be used. These may be used alone or in combination.

In the developer, the charge control agent may be included (internally added) in toner particles or be used by mixing (externally added) with toner particles for the purpose of improving the triboelectric charge characteristics. The amount of charge is easily optimally controlled in accordance with a developing system by using the charge control agent. At least one charge control agent selected from charge control agents for toner may be used.

Process Cartridge

The entire process cartridge B according to an embodiment of the present disclosure will be described with reference to FIG. 5.

The process cartridge B includes a cleaning unit 60 and a developing apparatus 20 having the configuration shown in FIG. 4. In general, in the process cartridge B, an electrophotographic photosensitive drum 62 and at least one of a charging device, a developing device, and a cleaning device, serving as a process device for acting on the electrophotographic photosensitive drum 62 are integrally made into a cartridge so as to be detachably attached to a main body of the image forming apparatus C. In the present disclosure, the process cartridge B includes the cleaning unit 60.

The cleaning unit 60 includes the electrophotographic photosensitive drum, a charging roller 66, a cleaning member 77, and a cleaning frame 71 for supporting these. In the cleaning unit 60, each of the charging roller 66 and the cleaning member 77 is arranged in contact with the outer peripheral surface of the electrophotographic photosensitive drum 62.

The cleaning member 77 is in contact with the electrophotographic photosensitive drum 62 in the counter direction relative to the rotational direction R of the electrophotographic photosensitive drum 62. That is, the cleaning member 77 is in contact with the electrophotographic photosensitive drum 62 such that the front edge portion thereof points the upstream side in the rotational direction of the electrophotographic photosensitive drum 62.

A waste toner chamber 71*b* is disposed inside the cleaning frame 71, and a scooping sheet 65 for preventing leakage of a waste toner is disposed in front of the cleaning member 77. The electrophotographic photosensitive drum 62 receives a driving force from a main body driving motor (not shown in the drawing) serving as a driving source and is driven to rotate in the direction of arrow R shown in the drawing in accordance with an image forming operation.

The charging roller 66 is rotatively attached to the cleaning unit 60. The charging roller 66 is in pressure contact with the electrophotographic photosensitive drum 62 by being pressed against the electrophotographic photosensitive drum 62 and rotates so as to follow rotation of the electrophotographic photosensitive drum 62.

As shown in FIG. 4 and FIG. 5, the developing apparatus 20 includes the developer bearing roller 32, a developing container 23 for supporting the developer bearing roller 32, a developer regulating member 11, and the like. A magnet roller 34 is disposed in the developer bearing roller 32. In the developing apparatus 20, the developer regulating member 11 is disposed so as to regulate the thickness of the developer layer on the developer bearing roller 32. Spacing members (not shown in the drawing) are attached to both end portions of the developer bearing roller 32. The spacing members are in contact with the electrophotographic photosensitive drum 62 and, thereby, the developer bearing roller 32 and the electrophotographic photosensitive drum 62 are held with a small clearance therebetween. A blowout-preventing sheet 33 for preventing leakage of the developer from the developing apparatus 20 is disposed so as to come into contact with the developer bearing roller 32. Further, a carrying member 43 is disposed in a developer chamber 29 formed by the developing container 23. The carrying member 43 agitates the developer accommodated in the developer chamber 29 and, in addition, carries the developer from a developer chamber outlet 29*a* to a developer supply chamber 28.

The developing apparatus 20 has a configuration in which the cleaning unit 60 is energized by a energization force of a spring and, thereby, the developer bearing roller 32 is reliably pressed in the direction toward the electrophotographic photosensitive drum 62. Then, the developer bearing roller 32 is held at a predetermined distance from the electrophotographic photosensitive drum 62 by the spacing members attached to both end portions of the developer bearing roller 32.

Image Forming Apparatus

The image forming apparatus C shown in FIG. 5 is a laser beam printer, in which the process cartridge B is detachably attached to the image forming apparatus C, based on the electrophotographic technology. When the process cartridge B is attached to the image forming apparatus C, an exposing unit 51 (laser scanner unit) for forming a latent image on the electrophotographic photosensitive drum 62 of the process cartridge B is arranged. Also, a sheet tray (not shown in the drawing) containing a recording medium (hereafter referred to as sheet member P), on which an image is formed, is arranged under the process cartridge B.

Further, in the image forming apparatus C, transferring roller 52, a fixing unit 53, a discharging tray 42, and the like are arranged sequentially in the conveyance direction D of the sheet member P.

The image forming apparatus C shown in FIG. 5 has a configuration, in which the process cartridge B is detachably incorporated, but may have a structure, in which the units and the portions incorporated as the process cartridge in the above-described image forming apparatus C are exchangeably fixedly disposed, not in the form of a process cartridge, in the apparatus.

Next, an outline of the image forming process will be described.

The electrophotographic photosensitive drum 62 is driven to rotate in the direction of arrow R at a predetermined circumferential velocity (process speed) on the basis of a print start signal. The charging roller 66, to which a bias voltage has been applied, comes into contact with the outer peripheral surface of the electrophotographic photosensitive drum 62 and equally uniformly charges the outer peripheral surface of the electrophotographic photosensitive drum 62.

The exposing unit 51 outputs laser light L in accordance with the image information. The laser light L passes through a laser opening disposed in the cleaning frame 71 of the process cartridge B and scanning-exposes the outer peripheral surface of the electrophotographic photosensitive drum 62. Consequently, an electrostatic latent image in accordance with the image information is formed on the outer peripheral surface of the electrophotographic photosensitive drum 62.

Meanwhile, in the developing apparatus 20, a developer T in the developer chamber 29 is agitated and carried due to rotation of the carrying member 43 and is sent to the developer supply chamber 28. The developer T is borne on the surface of the developer bearing roller 32 by the magnetic force of the magnet roller 34 (stationary magnet). The developer T is triboelectrically charged and the layer thickness thereof on the circumferential surface of the developer bearing roller 32 is regulated by the developer regulating member 11. The developer T develops on the electrophotographic photosensitive drum 62 in accordance with the electrostatic latent image so as to form a developer image that is a visible image.

As shown in FIG. 5, the sheet member P contained in a lower portion of the image forming apparatus C is sent out from the sheet tray in accordance with the output timing of the laser light L. The sheet member P is conveyed to a transfer position between the electrophotographic photosensitive drum 62 and the transferring roller 52. At this transfer position, the developer images are sequentially transferred from the electrophotographic photosensitive drum 62 to the sheet member P.

The sheet member P, to which the developer image has been transferred, is separated from the electrophotographic photosensitive drum 62 and is conveyed to the fixing unit 53. The sheet member P passes through the contact region between a heating roller and a pressing roller constituting the fixing unit 53. Pressure-heat fixing treatment is performed in the contact region and, thereby, the developer image is fixed to the sheet member P. The sheet member P subjected to the fixing treatment of the developer image is discharged into the discharge tray 42.

Regarding the electrophotographic photosensitive drum 62 after transfer, a residual developer on the outer peripheral surface is removed by the cleaning member 77, and the electrophotographic photosensitive drum 62 is used again for the image forming process. The developer removed from the electrophotographic photosensitive drum 62 is stored in the waste toner chamber 71*b* of the cleaning unit 60.

In the above description, the charging roller 66, the developer bearing roller 32, the transferring roller 52, and the cleaning member 77 are the process devices for acting on the electrophotographic photosensitive drum 62.

According to an aspect of the present disclosure, a process cartridge and an electrophotographic image forming apparatus, which are useful for stably forming a high-quality electrophotographic image, are provided.

EXAMPLES

Examples and comparative examples will be described below, but the present disclosure is not limited to only these examples.

Example 1 Production Example 1 Production of Developer Regulating Member

Preparation of Raw Material

A prepolymer was produced by reacting the following components in a nitrogen atmosphere at 80° C. for 3 hours.

4,4'-Diphenylmethane diisocyanate (MDI) (trade name "MILLIONATE MT"; produced by Tosoh Corporation): 29.7 parts by mass Polybutylene adipate (PBA) (trade name "NIPPOLAN 4010"; produced by Tosoh Corporation): 70.3 parts by mass Further, a curing agent was produced by mixing the following components.

1,4-Butane diol (produced by MITSUBISHI CHEMICAL CORPORATION): 43.9 parts by mass Trimethylolpropane (TMP) (produced by Mitsubishi Gas Chemical Company, Inc.): 23.7 parts by mass Triethylenediamine (TEDA) (trade name "Dabco Crystalline"; produced by Air Products Japan, Inc.): 0.037 parts by mass Molding A cylindrical mold heated to 130° C. was rotated at 800 rpm and 100 parts by mass of prepolymer was mixed with 6.76 parts by mass of curing agent and was injected. After injection, heat-curing was performed for 30 minutes, a thin cylindrical sheet was removed from the cylindrical mold, and secondary curing was performed at 130° C. for 4 hours. The thickness of the sheet was 1.0 mm. The resulting sheet was cut by using a VIC cutting die, which was formed such that the sheet had predetermined dimensions, so as to produce a developer regulating member having a polyurethane (PU) blade portion. The resulting developer regulating member was bonded, by using an adhesive, to a sheet metal processed in advance so as to be attached to a predetermined cartridge.

Table 1 shows the width (W) in the longitudinal direction of the developer regulating member, the width (W1') of a substantially straight line portion in the width OM in the longitudinal direction of the region 105-1*a* corresponding to the developing region 103-2, the width (W2) in the longitudinal direction of the edge portion 105-1*c*, the width (W3) in the longitudinal direction of the connection region 105-1*b*, and the length (D1) in the region 105-1*a* and a minimum length of the length (D2) in the edge region 105-1*c* of the developer regulating member in example 1. In this regard, the relationships between W1 to W3, W1', L1 to L3, D1, and D2 are as shown in FIGS. 2A and 2B.

Developing Apparatus

The developer regulating member produced by the above-described method was incorporated into a processed developing apparatus of a process cartridge (trade name: CE278AD, produced by Hewlett-Packard Company). A developer of the process cartridge was one magnetic component, a developer bearing roller was a developing sleeve including a magnet roller, and the width of a developing region was 210 mm. In the contact region between the developer regulating member and the developer bearing roller in the process cartridge, the distance L1 from the end portion on the upstream side in the rotational direction of the developer bearing roller to the front edge position of the developer regulating member was set to be the value shown in Table 1. Also, the value of the distance L2 of a protruding portion at the end portion of the contact region is shown in Table 1.

Image Evaluation by Using Image Forming Apparatus

The process cartridge incorporated with each of the developing apparatuses of examples and comparative examples was attached to an electrophotographic image forming apparatus (trade name: LaserJet Pro P1606dn, produced by Hewlett-Packard Company), and an evaluation image was printed in each of the environments described below so as to perform the image evaluation.

Rating of Soiling of Image

The developing apparatus was left to stand for 24 hours at a high temperature of 30° C. and a high humidity of 80%. Thereafter, 1,000 sheets of image were printed in the above-described environment, the margin of the image of the 1000th printed sheet was visually observed, and presence or absence of occurrence of soiling of the image due to developer scattering was examined. Subsequently, the process cartridge was removed, and presence or absence of adhesion of the developer, due to scattering, in the electrophotographic image forming apparatus or onto the outer frame of the process cartridge was examined. Evaluation was performed on the basis of the criteria described below.

Rank A: No soiling of the image was observed in the margin of the image of the sheet, and no adhesion of the developer, due to scattering, in the electrophotographic image forming apparatus or onto the outer frame of the process cartridge was observed.

Rank B: No soiling of the image was observed in the margin of the image of the sheet, but adhesion of the developer, due to scattering, in the electrophotographic image forming apparatus or onto the outer frame of the process cartridge was observed.

Rank C: Soiling of the image was observed in the margin of the image of the sheet.

Rating of Density

The developing apparatus was left to stand for 24 hours at a high temperature of 30° C. and a high humidity of 80%. Thereafter, regarding the image density, 10 sheets of solid black image were printed in the above-described environment, and the density of solid black image of the 10th printed sheet was measured by using a Macbeth reflection densitometer (produced by Macbeth). Regarding the densities of the end portions of the printed image, the measurement positions were 5 positions in total, that is, positions at 5 mm from the end portions in the transverse direction of the printed image and at 5 mm from the end portions and at the center position in the longitudinal direction of the printed image. Regarding the density of the central portion, the center position of the printed image was measured. The densities of the end portions and the density of the central portion were compared, and the result that exhibited the largest difference was used for the evaluation. The evaluation was performed on the basis of the criteria described below.

Rank A: The density of the end portion was 90% or more of the density of the image central portion Rank B: The density of the end portion was 80% or more and less than 90% of the density of the image central portion Rank C: The density of the end portion was less than 80% of the density of the image central portion Rating of Poor Regulation The developing apparatus was left to stand for 24 hours at a low temperature of 15° C. and a low humidity of 15%. Thereafter, regarding the image of the 1000th sheet obtained in the same manner as described above in the above-described environment, the end portion of the image was visually observed, and presence or absence of occurrence of ripple-like image defect was examined. Subsequently, the developing apparatus was decomposed, and regarding occurrence of stick of the developer, the states of the developer regulating member and the developer bearing roller were examined. Evaluation was performed on the basis of the criteria described below.

Rank A: No ripple-like image defect occurred and no stick occurred.

Rank B: No ripple-like image defect occurred but stick occurred.

Rank C: Ripple-like image defect occurred.

Examples 2 to 14

Developer regulating members were formed in the same manner as example 1 except that cutting was performed by using a VIC cutting die, which was formed such that the dimensions shown in Table 1 and Table 2 were achieved. In the contact region between the developer regulating member and the developer bearing roller in the process cartridge, the distance L1 from the end portion on the upstream side in the rotational direction of the developer bearing roller to the front edge position of the developer regulating member was set to be each of the values shown in Table 1 and Table 2. Also the value of the distance L2 of a protruding portion at the end portion of the contact region is shown in Table 1 and Table 2.

Example 15

An image evaluation was performed by using the image forming apparatus in the same manner as example 1 except that a stainless steel member (SUS-304-1/2H) that was pressed so as to have dimensions shown in Table 2 and had a thickness of 0.08 mm was attached as the developer regulating member to the cartridge. In the contact region between the developer regulating member and the developer bearing roller in the process cartridge, the distance L1 from the end portion on the upstream side in the rotational direction of the developer bearing roller to the front edge position of the developer regulating member was set to be the value shown in Table 2. Also the value of the distance L2 of a protruding portion at the end portion of the contact region is shown in Table 2.

Example 16

Figure 6:
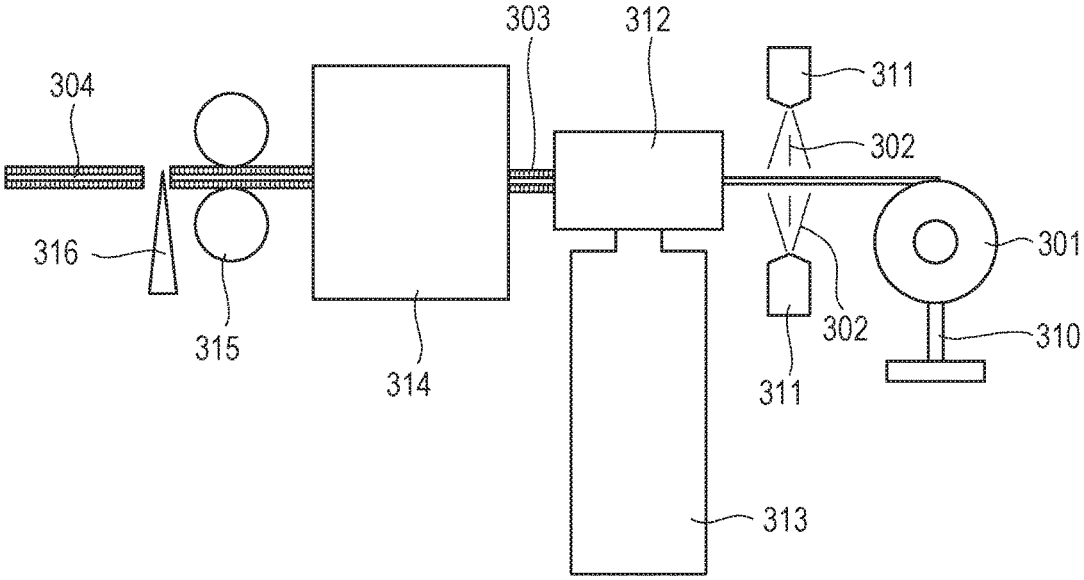
FIG. 6 is a diagram showing an example of an apparatus for producing a developer regulating member used in a developing apparatus according to the present disclosure.

FIG. 6 shows a method for producing the developer regulating member.

A thermoplastic ester resin (TPER) (trade name: Hytrel 4047N, produced by DU PONT-TORAY CO. LTD.) was used as the material for forming a regulating portion (blade portion). A long sheet having a width of 12 mm of a stainless steel member (SUS-304-1/2H) having a thickness of 0.08 mm was used as a supporting portion.

The material for forming the regulating portion was melted in an extruder 313 at 200° C. and was injected into a molding cavity of an extruder die 312. At the same time, one end surface in the longitudinal direction of the supporting portion was covered with the regulating portion having a thickness of 0.1 mm and a width in the transverse direction of 5 mm while the one end surface of the supporting portion was passed through the molding cavity of the extruder die.

The supporting portion was sent out from a dispenser 310, into which a roll member 301 for the supporting portion had been set, by using a roller pair 315 and was brought into the extruder die 312. In the case where the adhesiveness between the supporting portion and the blade member is weak, as shown in FIG. 6, a coating machine 311 for applying an adhesive 302 may be disposed upstream of the die 312.

The temperature of the die 312 was set to be 250° C. A regulating portion 303 ejected from the die 312 was solidified by using a cooler 314 so as to produce a long member of the developer regulating member in which one end portion side of the supporting portion was covered with the regulating member. The long member of the developer regulating member was cut by using a cutter 316 into the length shown in Table 2 in the longitudinal direction and was cut such that the edge region had the shape with dimensions shown in Table 1 so as to produce a developer regulating member 304. The resulting developer regulating member was fixed to a steel sheet by welding, and was processed so as to be attached to the cartridge. In the contact region between the developer regulating member and the developer bearing roller in the process cartridge, the distance L1 from the end portion on the upstream side in the rotational direction of the developer bearing roller to the front edge position of the developer regulating member was set to be the value shown in Table 2. Also, the value of the distance L2 of a protruding portion at the end portion of the contact region is shown in Table 2.

Comparative Examples 1 to 3

Developer regulating members were formed in the same manner as example 1 except that cutting was performed by using a VIC cutting die, which was formed such that the dimensions shown in Table 3 were achieved. In the contact region between the developer regulating member and the developer bearing roller in the process cartridge, the distance L1 from the end portion on the upstream side in the rotational direction of the developer bearing roller to the front edge position of the developer regulating member was set to be each of the values shown in Table 3. Also, the value of the distance L2 of a protruding portion at the end portion of the contact region is shown in Table 3. Each of the developer regulating members of comparative examples 1 to 3 had a shape in which the end portion in the width direction of the front edge portion was located in the contact region between the developer bearing roller and the developer regulating member.

Table 4 and Table 5 show the evaluation results of the image forming apparatuses produced by using the process cartridges according to examples 1 to 16 and comparative examples 1 to 3.

TABLE 1

| | Example | | | | | | | |
|---|---|---|---|---|---|---|---|---|
| | 1 | 2 | 3 | 4 | 5 | 6 | 7 | 8 |
| Material for blade of developer regulating member | PU | PU | PU | PU | PU | PU | PU | PU |
| W (mm) | 220.0 | 220.0 | 220.0 | 220.0 | 219.8 | 220.0 | 220.0 | 220.0 |
| W1 (mm) | 210.0 | 210.0 | 210.0 | 210.0 | 210.0 | 210.0 | 210.0 | 210.0 |
| W1' (mm) | 210.0 | 205.5 | 210.0 | 205.7 | 210.0 | 210.0 | 210.0 | 210.0 |
| W2 (mm) | 1.4 | 3.5 | 1.4 | 3.5 | 0.0 | 4.0 | 3.0 | 1.7 |
| W3 (mm) | 3.6 | 1.5 | 3.6 | 1.5 | 4.9 | 1.0 | 2.0 | 3.3 |
| D1 (mm) | 12.0 | 12.0 | 11.3 | 12.0 | 12.0 | 11.4 | 12.0 | 11.5 |
| D2 (mm) | 10.3 | 11.0 | 9.6 | 10.3 | 10.2 | 9.6 | 10.3 | 10.3 |
| L1 (mm) | 2.5 | 2.5 | 1.8 | 2.5 | 2.5 | 1.9 | 2.5 | 2.0 |
| L2 (mm) | 0.8 | 1.5 | 0.1 | 0.8 | 0.7 | 0.1 | 0.8 | 0.8 |
| L3 (mm) | 2.5 | 1.9 | 1.8 | 1.5 | 2.5 | 1.9 | 2.5 | 2.0 |

TABLE 2

| | Example | | | | | | | |
|---|---|---|---|---|---|---|---|---|
| | 9 | 10 | 11 | 12 | 13 | 14 | 15 | 16 |
| Material for blade of developer regulating member | PU | PU | PU | PU | PU | PU | SUS | TPEE/SUS |
| W (mm) | 220.0 | 220.0 | 220.0 | 213.8 | 219.8 | 215.2 | 220.0 | 220.0 |
| W1 (mm) | 210.0 | 210.0 | 210.0 | 210.0 | 210.0 | 210.0 | 210.0 | 210.0 |
| W1' (mm) | 210.0 | 210.0 | 210.0 | 210.0 | 204.4 | 208.0 | 210.0 | 210.0 |
| W2 (mm) | 5.0 | 2.1 | 3.3 | 0.9 | 3.4 | 1.4 | 1.4 | 1.4 |
| W3 (mm) | 0.0 | 2.9 | 1.7 | 1.0 | 1.5 | 1.2 | 3.6 | 3.6 |
| D1 (mm) | 12.0 | 15.0 | 9.9 | 11.5 | 12.0 | 11.8 | 12.0 | 12.0 |
| D2 (mm) | 10.3 | 10.9 | 9.6 | 10.5 | 10.0 | 11.2 | 10.3 | 10.3 |
| L1 (mm) | 2.5 | 5.5 | 0.4 | 2.0 | 2.5 | 2.3 | 2.5 | 2.5 |
| L2 (mm) | 0.8 | 1.4 | 0.1 | 1.0 | 0.5 | 1.7 | 0.8 | 0.8 |
| L3 (mm) | 2.5 | 5.5 | 0.4 | 2.0 | 1.2 | 2.0 | 2.5 | 2.5 |

TABLE 3

| Material for blade of developer regulating member | Comparative example 1 PU | Comparative example 2 PU | Comparative example 3 PU |
|---|---|---|---|
| W (mm) | 220.0 | 220.0 | 219.8 |
| W1 (mm) | 210.0 | 210.0 | 210.0 |
| W1' (mm) | 210.0 | 210.0 | 210.0 |
| W2 (mm) | 1.3 | 5.0 | 0.0 |
| W3 (mm) | 3.7 | 0.0 | 4.9 |
| D1 (mm) | 11.5 | 10.9 | 10.9 |
| D2 (mm) | 9.2 | 9.2 | 9.2 |
| L1 (mm) | 2.0 | 1.4 | 1.4 |

TABLE 3-continued

| Material for blade of developer regulating member | Comparative example 1 PU | Comparative example 2 PU | Comparative example 3 PU |
|---|---|---|---|
| L2 (mm) | −0.3 | −0.3 | −0.3 |
| L3 (mm) | 2.0 | 1.4 | 1.4 |

TABLE 4

| | | Example | | | | | | | | | | | | | | | |
|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 14 | 15 | 16 |
| Soiling of image | Soiling of image end portion | none | none | none | none | none | none | none | none | none | none | none | none | none | none | none | none |
| | Soiling in apparatus | none | none | none | none | none | none | none | none | none | none | none | none | none | none | none | none |
| | Rating of scattering | A | A | A | A | A | A | A | A | A | A | A | A | A | A | A | A |
| Density | Ratio of density relative to central portion | 99% | 97% | 95% | 91% | 98% | 95% | 98% | 98% | 79% | 99% | 95% | 86% | 89% | 99% | 97% | 97% |
| | Rating of density | A | A | A | A | A | A | A | A | C | A | A (generally low density) | B | B | A | A | A |
| Poor regulation | Occurrence of ripple-like pattern | none | none | none | none | none | none | none | none | none | none | none | none | none | none | none | none |
| | Stick of developer | none | none | none | none | yes | none | none | none | none | yes | none | yes | none | yes | none | none |
| | Rating of poor regulation | A | A | A | A | B | A | A | A | A | B | A | B | A | B | A | A |

TABLE 5

| | | Comparative example 1 | Comparative example 2 | Comparative example 3 |
|---|---|---|---|---|
| Soiling of image | Soiling of image end portion | yes | yes | yes |
| | Soiling in apparatus | yes | yes | yes |
| | Rating of scattering | C | C | C |
| Density | Ratio of density relative to central portion | 98% | 77% | 98% |
| | Rating of density | A | C | A |
| Poor regulation | Occurrence of ripple-like pattern | none | none | none |
| | Stick of developer | none | none | yes |
| | Rating of poor regulation | A | A | B |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-118398 filed Jun. 14, 2016 and No. 2016-155783 filed Aug. 8, 2016 which are hereby incorporated by reference herein in their entirety.

What is claimed is:

1. A process cartridge comprising:

an electrophotographic photosensitive drum;

a developer bearing roller for supplying a developer to an electrostatic latent image forming region of the electrophotographic photosensitive drum; and a developer regulating member in contact with a surface of the developer bearing roller, wherein the developer bearing roller is rotatable in the direction of supplying the developer to the electrostatic latent image forming region and has a developer bearing region on the surface, the developer bearing region includes a developing region for bearing the developer with which an electrostatic latent image formed in the electrostatic latent image forming region is developed, the developer bearing region has a width, in the direction of the axis of the developer bearing roller, larger than the width of the developing region, the developer regulating member and the developer bearing roller are arranged such that the center of the developer regulating member is in accord with the center of the developer bearing region in the direction of the axis of the developer bearing roller so as to constitute a contact region, the contact region has a width larger than the width of the developing region in the direction of the axis of the developer bearing roller and extends in the circumferential direction of the developer bearing roller, the developer regulating member has a protruding portion that protrudes over the entire width of the contact region from the end portion on the upstream side of the contact region in the upstream direction and in the direction in which the developer bearing roller is rotatable, and a protrusion length L1 of the protruding portion in a direction perpendicular to a width direction of the developer regulating member, in a region corresponding to the developing region is substantially constant and larger than a protrusion length L2 of the protruding portion in a direction perpendicular to a width direction of the developer regulating member, at the location corresponding to the end portion in the width direction of the contact region, and wherein the developer regulating member has a connection region in which the protrusion length of the protruding portion gradually decreases from the start point that corresponds to the end portion of the developing region toward a location corresponding to the end portion of the contact region, the connection region has a width of at least 1 mm in the direction of the axis of the developer bearing roller, and the amount of change in the protrusion length in the connection region is 0.1×L3 (mm) or less per 0.1 mm of width of the connection region, when the protrusion length of the end portion in a region corresponding to the developing region is assumed to be L3 (mm).

2. The process cartridge according to claim 1, wherein formula (1) below is satisfied when the maximum value of the protrusion length of the protruding portion in the region corresponding to the developing region is assumed to be L1max (mm) and the minimum value is assumed to be L1min (mm), $$[(L1\max - L1\min)/L1\max] \leq 0.4. \quad \text{Formula (1)}$$

3. The process cartridge according to claim 1, wherein L2≤L3×0.8 is satisfied when the protrusion length of the protruding portion at the location corresponding to the end portion in the width direction of the contact region is assumed to be L2 (mm).

4. The process cartridge according to claim 2, wherein L1max is 0.5 mm or more and 5.0 mm or less.

5. The process cartridge according to claim 1, wherein the width from the location corresponding to the end portion in the width direction of the developing region to the location corresponding to the end portion in the width direction of the contact region of the developer regulating member is 2 mm or more and 10 mm or less.

6. The process cartridge according to claim 1, wherein the developer regulating member has an end region in which the protrusion length of the protruding portion from the location corresponding to the end portion of the contact region toward the center in the width direction of the developer regulating member is substantially constant and the protrusion length in the end region is within the range of 0.8×L2 (mm) or more and 1.2×L2 (mm) or less with reference to the L2.

7. The process cartridge according to claim 6, wherein the width of the end region is 1.0 mm or more and 5.0 mm or less.

8. An electrophotographic image forming apparatus comprising:

an electrophotographic photosensitive drum;

a developer bearing roller for supplying a developer to an electrostatic latent image forming region of the electrophotographic photosensitive drum; and a developer regulating member in contact with a surface of the developer bearing roller, wherein the developer bearing roller is rotatable in the direction of supplying the developer to the electrostatic latent image forming region and has a developer bearing region on the surface, the developer bearing region includes a developing region for bearing the developer with which an electrostatic latent image formed in the electrostatic latent image forming region is developed, the developer bearing region has a width, in the direction of the axis of the developer bearing roller, larger than the width of the developing region, the developer regulating member and the developer bearing roller are arranged such that the center of the developer regulating member is in accord with the center of the developer bearing region in the direction of the axis of the developer bearing roller so as to constitute a contact region, the contact region has a width larger than the width of the developing region in the direction of the axis of the developer bearing roller and extends in the circumferential direction of the developer bearing roller, the developer regulating member has a protruding portion that protrudes over the entire width of the contact region from the end portion on the upstream side of the contact region in the upstream direction and in the direction in which the developer bearing roller is rotatable, and a protrusion length L1 of the protruding portion in a direction perpendicular to a width direction of the developer regulating member, in a region corresponding to the developing region is substantially constant and larger than a protrusion length L2 of the protruding portion in a direction perpendicular to a width direction of the developer regulating member, at the location corresponding to the end portion in the width direction of the contact region, and wherein the developer regulating member has a connection region in which the protrusion length of the protruding portion gradually decreases from the start point that corresponds to the end portion of the developing region toward a location corresponding to the end portion of the contact region, the connection region has a width of at least 1 mm in the direction of the axis of the developer bearing roller, and the amount of change in the protrusion length in the connection region is 0.1×L3 (mm) or less per 0.1 mm of width of the connection region, when the protrusion length of the end portion in a region corresponding to the developing region is assumed to be L3 (mm).

* * * * *